US011377912B2

(12) United States Patent
Sandhu

(10) Patent No.: US 11,377,912 B2
(45) Date of Patent: Jul. 5, 2022

(54) PUMPDOWN APPARATUS AND METHOD

(71) Applicant: CORDAX EVALUATION TECHNOLOGIES INC., Calgary (CA)

(72) Inventor: Charanjit Singh Sandhu, Calgary (CA)

(73) Assignee: CORDAX EVALUATION TECHNOLOGIES INC., Calgary (CA)

( * ) Notice: Subject to any disclaimer, the term of this patent is extended or adjusted under 35 U.S.C. 154(b) by 0 days.

(21) Appl. No.: 16/901,477

(22) Filed: Jun. 15, 2020

(65) Prior Publication Data

US 2020/0408049 A1 Dec. 31, 2020

Related U.S. Application Data

(60) Provisional application No. 62/861,849, filed on Jun. 14, 2019.

(51) Int. Cl.
*E21B 17/07* (2006.01)
*E21B 17/06* (2006.01)

(52) U.S. Cl.
CPC ..... *E21B 17/076* (2013.01); *E21B 17/06* (2013.01)

(58) Field of Classification Search
CPC ..... E21B 17/076; E21B 17/06; E21B 17/02; E21B 17/07; E21B 17/073
See application file for complete search history.

(56) References Cited

U.S. PATENT DOCUMENTS 3,552,718 A * 1/1971 Schwegman ..... E21B 34/14 251/291
4,077,472 A * 3/1978 Gano ..... E21B 33/043 166/382
7,416,034 B2 * 8/2008 Downie ..... E21B 17/076 175/107

* cited by examiner

*Primary Examiner* — Kristyn A Hall
(74) *Attorney, Agent, or Firm* — Bennett Jones LLP

(57) ABSTRACT

A shock absorber apparatus includes a rod; a tool connection on a first end of the rod; a piston on a second end of the rod; a flange on the rod between the tool connection and the piston; a ring connection slidably connected to the rod between the tool connection and the flange; a first spring between the ring connection and the flange to bias the ring connection axially away from the flange; a sleeve, connected to a second spring between the second spring and the piston, slidably encircling the piston and a portion of the rod, and extending past the piston to a pumpdown connection; and a fin. A method for a placing a tool in a landing ring of a drilling tubular includes using the shock absorber apparatus to absorb shocks caused by the landing operation.

7 Claims, 8 Drawing Sheets

PUMPDOWN APPARATUS AND METHOD

BENEFIT OF EARLIER APPLICATIONS

This application claims priority from U.S. provisional application 62/861,849, filed Jun. 14, 2019.

TECHNICAL FIELD

The present invention relates to conveyance equipment in general, and equipment for conveying tools down hole in a drilling operation in particular.

BACKGROUND

Logging while tripping (LWT) technology provides a way to monitor, record, and evaluate data during a drilling operation. For example, LWT may monitor an open-hole wellbore operation by using logging tools positioned within drill collars of a drill string in the wellbore.

Logging tools are used to measure downhole physical properties of the formation as the drill string, together with the logging tools at the landing ring, are pulled out of the hole. This operation is referred to as "tripping out." Various drilling operations and conditions may cause the tools to come out of alignment. For example, tools may be damaged by shock caused by sudden deceleration, such as when the tools are positioned at the landing ring. Therefore, there is a need for a device able to absorb such shocks while tools are conveyed down hole.

SUMMARY OF INVENTION

In accordance with a broad aspect of the present invention, there is provided a shock absorber apparatus for a pumpdown operation, comprising: a rod; a tool connection on a first end of the rod; a piston on a second end of the rod; a flange on the rod between the tool connection and the piston; a ring connection slidably connected to the rod between the tool connection and the flange; a first spring on the rod between the ring connection and the flange to bias the ring connection axially away from the flange; a second spring on the rod between the flange and a sleeve connection; a pumpdown connection; a sleeve, connected to the sleeve connection and the ring connection, slidably encircling the piston and a portion of the rod, and extending past the piston to the pumpdown connection; and a fin.

In accordance with another broad aspect of the present invention, there is provided a method of placing a tool in a landing ring of a drilling tubular, comprising: pumping the tool, connected to a shock absorber apparatus, into the drilling tubular toward the landing ring, absorbing a first shock, the first shock caused by a fin of the shock absorber apparatus being brought into contact with the landing ring, the first shock being at least partially absorbed by a first spring of the shock absorber apparatus being compressed; absorbing a second shock, the second shock caused when the first spring resiliently expands following the first shock, the second shock being at least partially absorbed by a second spring of the shock absorber apparatus being compressed.

It is to be understood that other aspects of the present invention will become readily apparent to those skilled in the art from the following detailed description, wherein various embodiments of the invention are shown and described by way of illustration. As will be realized, the invention is capable of other and different embodiments and its several details are capable of modification in various other respects, all within the present invention. Furthermore, the various embodiments described may be combined, mutatis mutandis, with other embodiments described herein. Accordingly, the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein.

(a)

(b)

(c)

(d)

(e)

(f)

(g)

(h)

(i)

(j)

(k)

DETAILED DESCRIPTION OF EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

The invention is related to downhole logging equipment, specifically to the conveyance of equipment down through drilling tubulars at the required depth. The pumpdown assembly pushes the logging tool down the drilling tubulars and the shock absorber apparatus absorbs the landing force. It can be adjusted to make sure the logging tool sits at a specific place in logging collars.

LWT uses relatively small diameter logging tools that are conveyed downhole through the inner conduit of drill pipe by pumping a tool string down a drilling tubular to LWT collars. The LWT collars may be connected to each other and/or to a landing element (such as a landing ring), typically in the bottom hole assembly (BHA). The landing ring may be positioned between collar connections of the BHA. The landing ring may be an elongate tubular member. The rig drills to the selected depth, and when the bit is at the bottom of the borehole, before the drill pipe is pulled out of the hole, the logging tools are pumped down, from the surface through the drill pipe until the tool string reaches the landing ring inside the LWT collars, using a pumpdown assembly.

Tools may be damaged by shock caused by sudden deceleration, such as when the tools are positioned at the landing ring. A shock absorber apparatus is provided for absorbing shocks to tools as they are positioned in a landing ring. With reference to FIGS. 1A-7, the shock absorber apparatus may include a rod 10, a tool connection 5 (for connection to one or more tools and/or a tool string) on a first end of the rod, and a piston 9 on a second end of the rod.

Figure 1A:
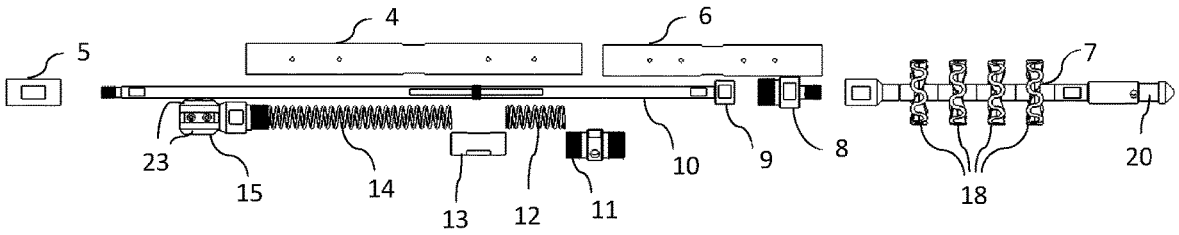
FIG. 1A is an exploded side elevation view of a shock absorber apparatus according to one embodiment of the present invention.
Figure 1B:
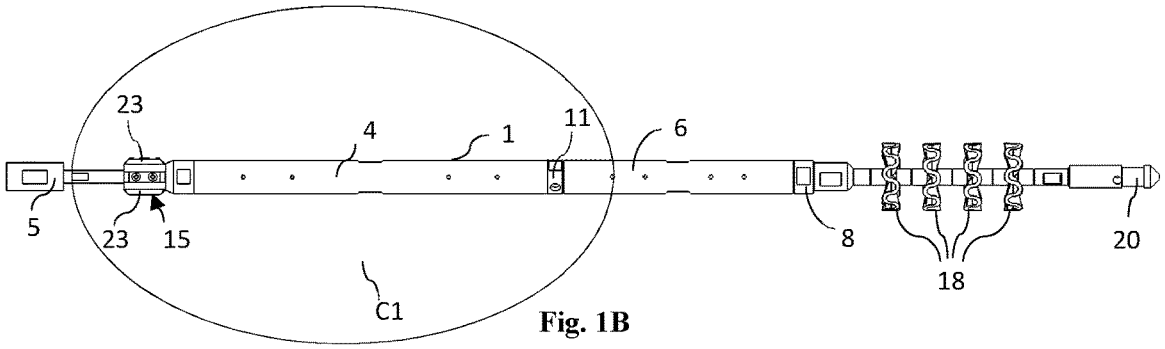
FIG. 1B is a side elevation view of the embodiment of FIG. 1A.
Figure 1C:
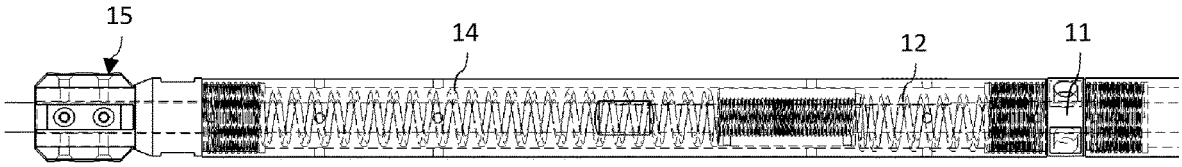
FIG. 1C is an enlarged area C1 of FIG. 1B with internal components shown in phantom.
Figure 2:
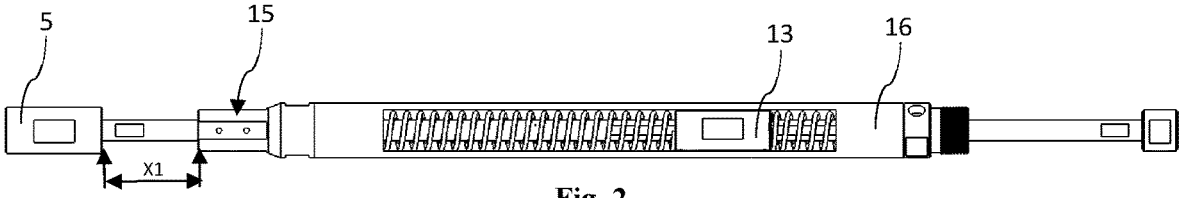
FIG. 2 is a side elevation view of a shock absorber apparatus with an adjusting sleeve according to another embodiment of the present invention.
Figure 3:
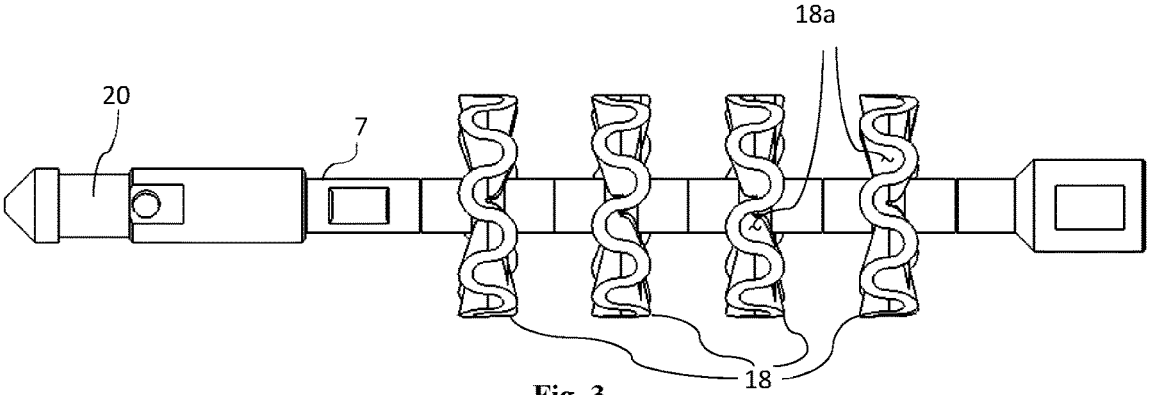
FIG. 3 is a side elevation view of wave discs and the fish neck of the embodiment of FIG. 1A.

A flange 13 may be on the rod between the tool connection and the piston. The flange may be a nut threaded onto threads on the rod, as illustrated in FIG. 1A.

Figure 5:
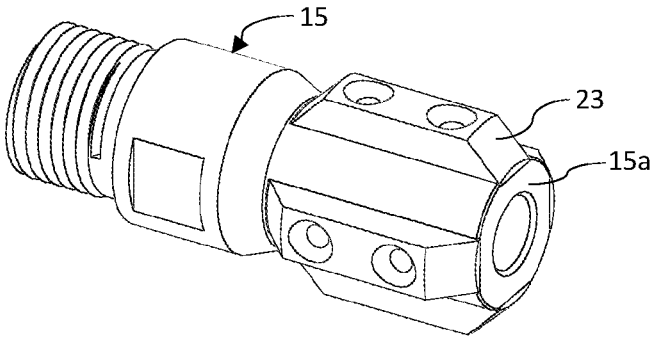
FIG. 5 is a side perspective view of the fin of the embodiment of FIG. 1A.

A fin 15 may be slidably connected to the rod between the tool connection and the flange. The fin may be configured to slidably move axially along the rod. The fin may be connected to a rod by an elongate tubular body with the fin extending radially therefrom. There may be any number of fins extending from the same tubular body. As illustrated in FIG. 5, the fin 15 may have an elongate tubular body and four fin members 23 extending radially therefrom. The length of the fin members may be selected according to an inner diameter of the landing ring.

A first spring 14 may be between the fin and the flange. The first spring 14 may bias the fin and the flange apart, and may absorb force between the fin and the flange, such as during a shock.

A second spring 12 may be positioned between the flange and a sleeve connection 11. The second spring may bias the flange axially away from the sleeve connection, and may absorb axial force exerted on the spring between the sleeve connection and the flange. The sleeve connection may be slidably connected to the rod between the second spring and the piston. The first spring may be longer than the second spring, and the distance between the first end and the flange may be greater than the distance between the flange and the piston. For example, the first spring may have an at-rest length of approximately 12" (for example, between 11" and 13"), and the second spring may have an at rest length of approximately 4" (for example, between 3" and 5"). In use, greater distance and spring length is required to absorb the first shock of the apparatus landing in the landing ring (which may be referred to as the restriction), than is required to absorb the second shock, which is caused by the recoil of the first spring after the first shock is absorbed.

A sleeve, which may include sleeves 4 and 6, may be connected to the sleeve connection to slidably encircle the piston and a portion of the rod. The sleeve may extend beyond the piston to a pumpdown connection 8. Sleeve 4 may be longer than sleeve 6. For example, sleeve 4 may be between 1.4 and 1.6 times the length of sleeve 6. The sleeve may include holes, such as holes 4*h* on sleeve 4 and 6*h* on sleeve 6, to permit fluid communication from inside the sleeve to outside the sleeve, which may slow down the apparatus as it travels through the drilling tubular.

The pumpdown connection may be connected to various further structures, including means for pumping the shock absorber apparatus down hole. The pumpdown connection 8 may be connected to a fish neck 20, which in operation may be connected to a tugger line for removal of the apparatus. One or more wave discs 18 may be between pumpdown connection 8 and fish neck 20.

Each wave disc may be a substantially planar disc with its edge extending radially away from the rod. The surface of the disc may have wave shaped peaks and valleys, with the amplitude and wave length of the wave increasing with the radius of the disc. If present, the one or more wave discs may provide friction and thereby slow down the apparatus as it travels vertically through the drilling tubular. The waves provide space for the fluid to pass, so the apparatus does not get stuck in the drilling tubular. If the apparatus is travelling through a horizontal section of the drilling tubular, the wave discs may allow fluid to push the apparatus more quickly therethrough.

The wave discs 18 may be used at an upper end of the apparatus to slow down speed of travel in a vertical section during pumping. The reason why the tool string needs to slow down is because if tool string is traveling too fast during pumping specially in double shoulder pipe, tools are exposed to large g forces and could suffer damage, so the wave disc helps to slow down the tool string speed during pumping by catching the fluid in the drill pipe. The wave disc also helps to push the tool string through any deviated or horizontal section of the well. Once the tool string is in a horizontal section, the rig starts to pump the mud and the wave disc catches the mud and pushes the tool string along with mud. The mud will still flow through wave disc channels 18*a* after the tool has landed on the landing ring, in other words, when the tool has stopped travelling after reaching the BHA destination. The wave disc also provides confirmation of when the apparatus lands on the landing ring. Once landed, the wave disc is at a stationary position, mud being pumped thereagainst will cause an increase in stand pipe pressure (SPP). Therefore, detection of increased SPP reliably suggests that the tool string has landed.

Any one or more of the rod, the tool connection, the piston, the flange, the second flange, and the sleeve may have flattened portions on their outer surfaces for engagement with vices, tongs or wrenches and other apparatus, for example, for assembly and repair.

An at-rest distance X1 between the tool connection 5 and the fin 15, which corresponds to how far the tool will rest past the landing ring, may be selected by varying any one or more of the following factors, among others: the length and strength (including resilience and/or resistance) of the springs, and the length of the rod between the flange and the tool connection. In one embodiment, for example, the flange may be moved axially toward or away from the tool connection by threadable engagement between the flange and the rod. The flange is used as an example, and the same may be true for various other components, such as the tool connection. The apparatus is therefore adjustable, and can be used and reused for operations of varying requirements. For adjusting operations, an adjusting sleeve 16 may be coupled to the flange 13. The adjusting sleeve 16 is similar to the sleeve 4 of the apparatus, but with an opening along a portion of its length to permit observation of internal parts.

FIGS. 4A-K illustrate how the shock absorber apparatus behaves in operation. FIGS. 4A-F show the shock absorber apparatus alone, and FIGS. 4G-K illustrate the same operation of the shock absorber apparatus as well as the collar and logging tools of the environment.

Figures 4A, 4B, 4C, 4D, 4E, 4F:
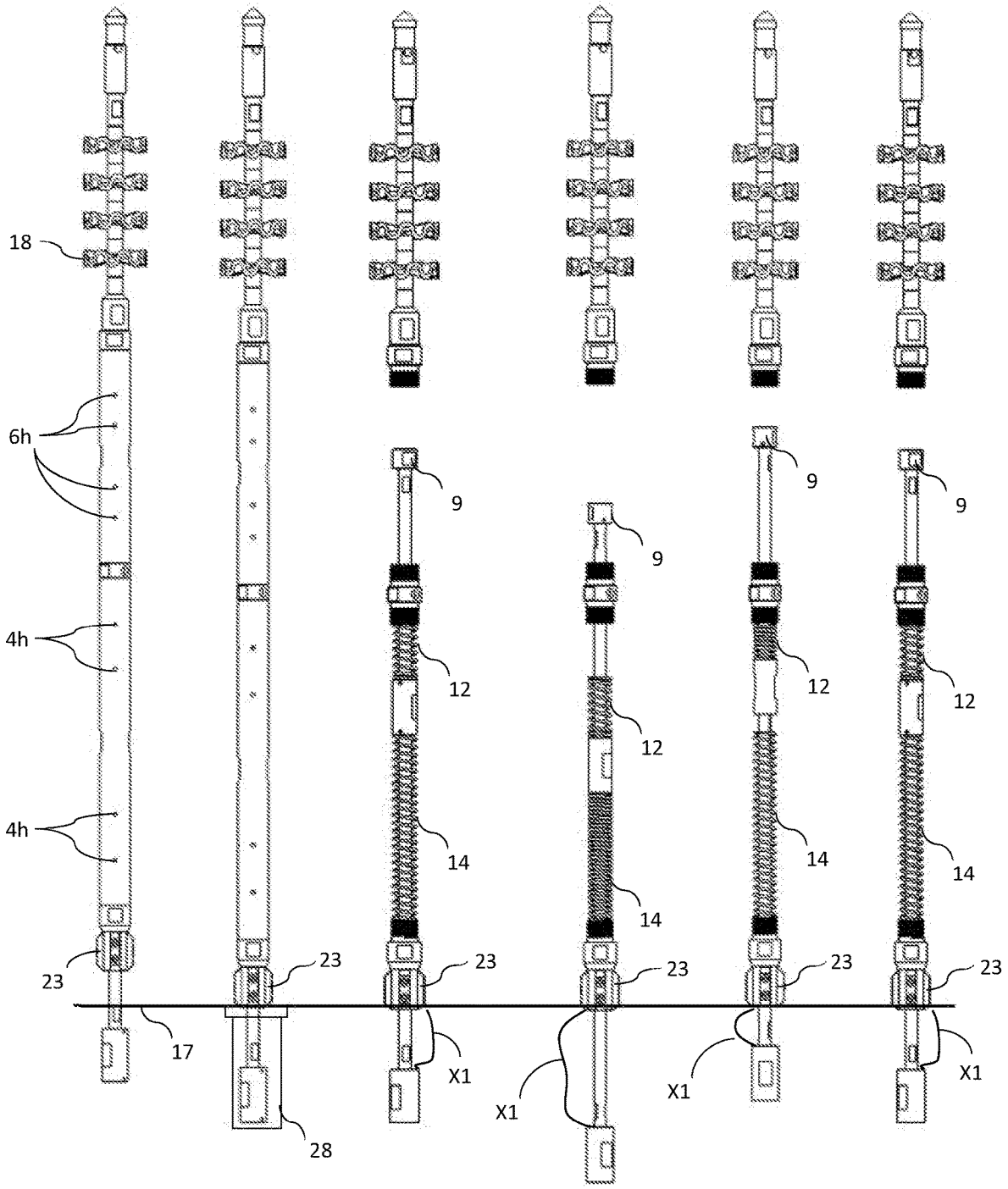
FIGS. 4A-4F are side elevation views of the embodiment of FIG. 1A in various stages of operation, with some components omitted to permit illustration of internal components.
Figures 4G, 4H, 4I, 4J, 4K:
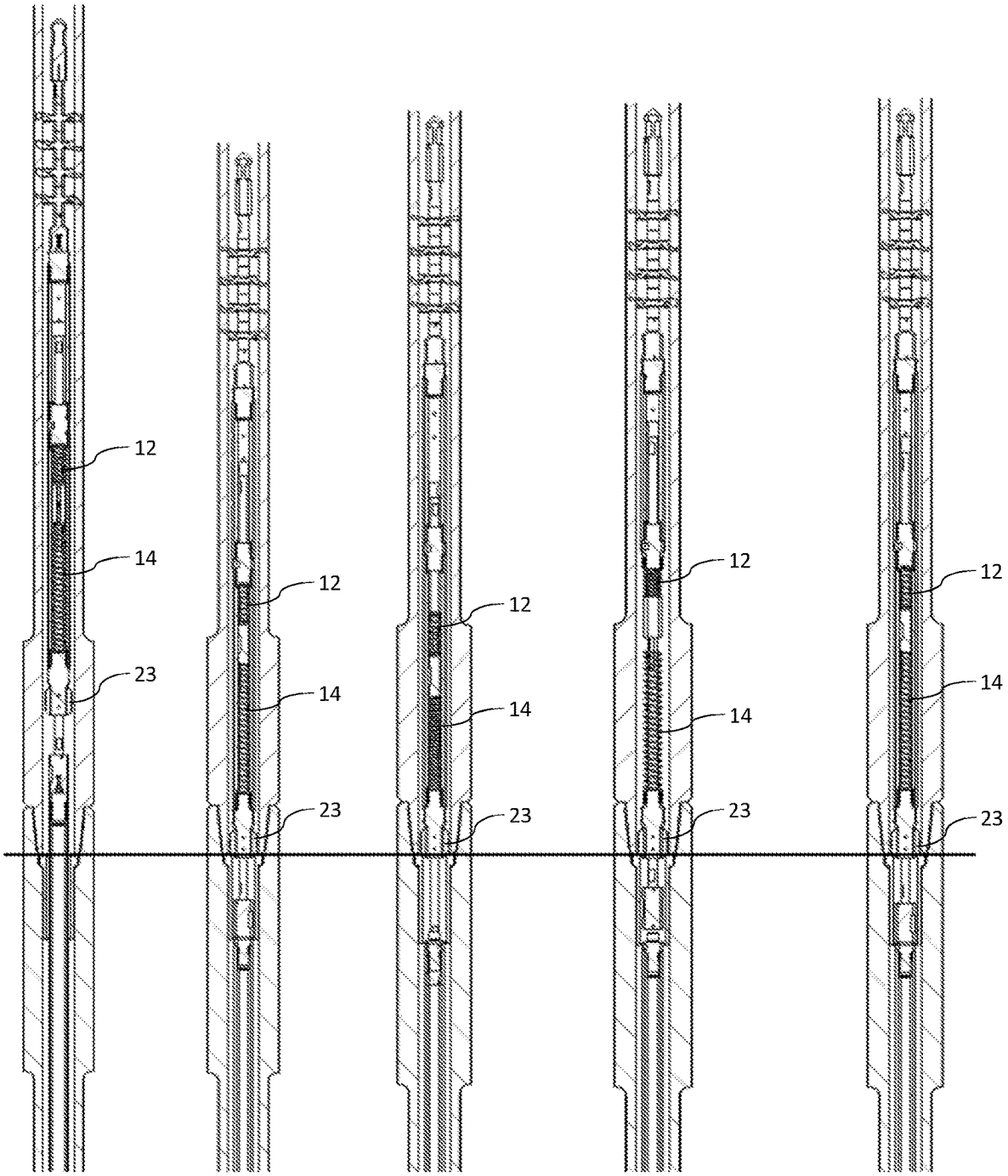
FIGS. 4G-4K are side elevation, partly cross sectional views of the embodiment of FIG. 1A in various stages of operation.

FIGS. 4A and 4F show the tool traveling down the hole just before landing fins 23 land in landing ring 28, FIGS. 4B and 4H show that the landing fins 23 (which may be referred to as pumpdown fins) are landed in landing ring 28. FIG. 4C represented same view as FIG. 4B, with sleeves 4, 6 removed to illustrate the operation of springs 12, 14.

In FIGS. 4D and 4I it can be seen that the spring 14 is compressed and spring 14 absorbs part of the landing force as the tool string lands on the ring. Inside the pumpdown assembly the piston 9 end of the pumpdown rod 10 is free and other end is connected to logging tools. When landing fins land on the landing ring, the logging tools and rod are still in motion, and spring 14 compresses to absorb the force, eventually stops the tool string from moving forward, and the X1 length increases.

In FIGS. 4E and 4J, spring 12 absorbs the impact as the spring 14 decompresses returning back to its neutral position after the tool landed on the landing ring. When spring 14 decompresses and returns to its neutral position, the tool string, due to its momentum, will continue to move in the same direction of the decompression of spring 14, and spring 12 will absorb the return impact as shown in FIGS. 4E and 4J, which causes the length X1 to become smaller.

In FIGS. 4F and 4K, the springs 12, 14 settled to their at-rest state and the apparatus sits in its neutral position. The drilling rig may then start to pull the apparatus out to the surface by pulling the drilling string and the included apparatus, landing and tool from the well's bore, during which the tool may collect data performing a LWT function.

Further Embodiments

Figure 6A:
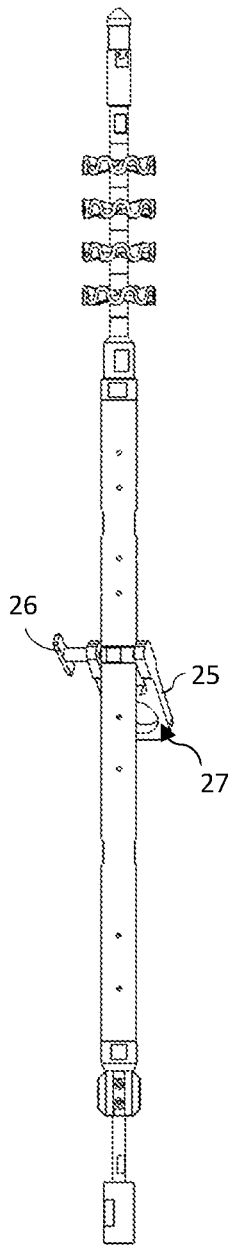
FIG. 6A is a rear elevation view of a shock absorber apparatus with a handle according to another embodiment of the present invention.
Figure 6B:
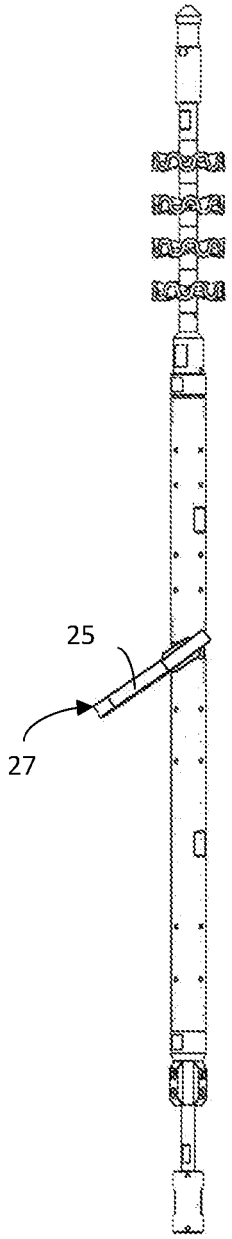
FIG. 6B is a side elevation view of the embodiment of FIG. 6A.
Figure 6C:
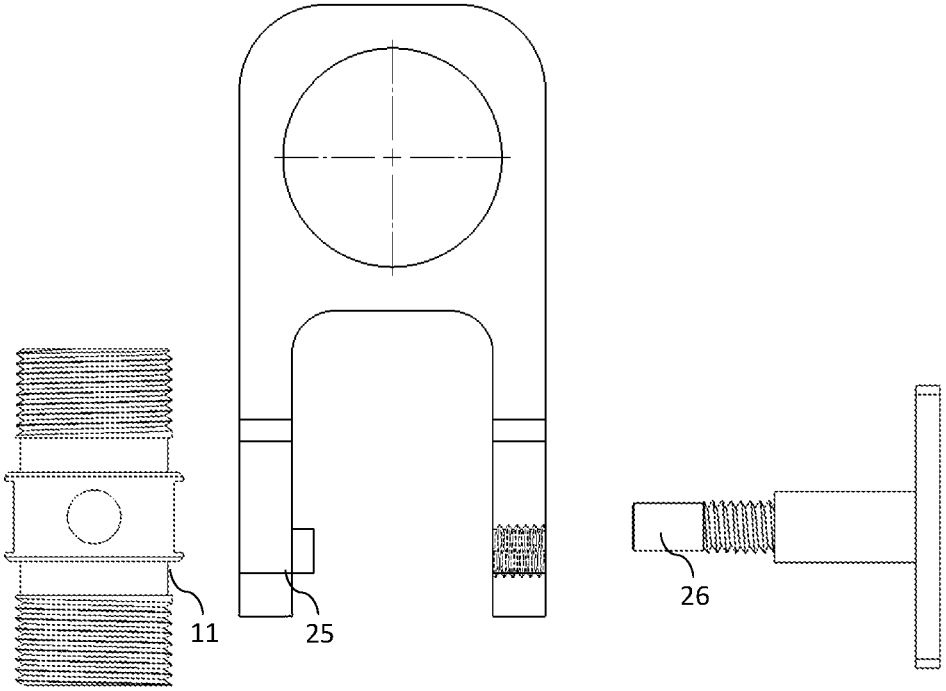
FIG. 6C is an elevation view of the components of the handle of FIG. 6A; and (l)

With reference to FIGS. 6A-B, a handle assembly 27 may be releasably connected to the apparatus, for example at sleeve connection 11, to facilitate handling of the apparatus by an operator when the apparatus is not down hole. Handle assembly 27 may include a handle 25 connectable to sleeve connection 11 with a bolt 26.

Figure 7:
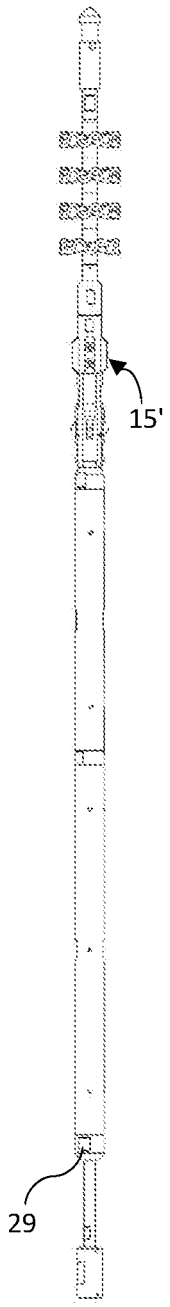
FIG. 7 is a side elevation view of a shock absorber apparatus according to another embodiment of the present invention.

As illustrated in FIG. 7, fin 15' may be positioned on the other side of the pumpdown connection relative to the springs. In such an embodiment, a ring connection 29 may be slidably connected to the rod between the tool connection and the flange, and the first spring may be between the ring connection and the flange to bias the ring connection axially away from the flange. In other words, ring connection 29 be provided in the place occupied by the fin 15 in embodiments described above.

Clauses

Clause 1. A shock absorber apparatus for a pumpdown operation, comprising: a rod; a tool connection on a first end of the rod; a piston on a second end of the rod; a flange on the rod between the tool connection and the piston; a ring connection slidably connected to the rod between the tool connection and the flange; a first spring on the rod between the ring connection and the flange to bias the ring connection axially away from the flange; a second spring on the rod between the flange and a sleeve connection; a pumpdown connection; a sleeve, connected to the sleeve connection and the ring connection, slidably encircling the piston and a portion of the rod, and extending past the piston to the pumpdown connection; and a fin.

Clause 2. The apparatus of any one or more of clauses 1-7, wherein the fin is connected to the ring connection.

Clause 3. The apparatus of any one or more of clauses 1-7, wherein the fin is connected to the pumpdown connection.

Clause 4. The apparatus of any one or more of clauses 1-7, wherein the sleeve includes a first sleeve segment and a second sleeve segment connected to each other by the sleeve connection.

Clause 5. The apparatus of any one or more of clauses 1-7, wherein the first spring is longer than the second spring; and a first distance, between the first end and the flange, is greater than a second distance, between the flange and the second end.

Clause 6. The apparatus of any one or more of clauses 1-7, further comprising a handle releasably coupleable to the sleeve.

Clause 7. A method of placing a tool in a landing ring of a drilling tubular, comprising: pumping the tool, connected to a shock absorber apparatus, into the drilling tubular toward the landing ring, absorbing a first shock, the first shock caused by a fin of the shock absorber apparatus being brought into contact with the landing ring, the first shock being at least partially absorbed by a first spring of the shock absorber apparatus being compressed; absorbing a second shock, the second shock caused when the first spring resiliently expands following the first shock, the second shock being at least partially absorbed by a second spring of the shock absorber apparatus being compressed.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A shock absorber apparatus for a pumpdown operation, comprising:

a rod;

a tool connection on a first end of the rod;

a piston on a second end of the rod;

a flange on the rod between the tool connection and the piston;

a ring connection slidably connected to the rod between the tool connection and the flange;

a first spring on the rod between the ring connection and the flange to bias the ring connection axially away from the flange;

a second spring on the rod between the flange and a sleeve connection, the second spring being configured to bias the flange axially away from the sleeve connection;

a pumpdown connection;

a sleeve, connected to the sleeve connection and the ring connection, slidably encircling the piston and a portion of the rod, and extending past the piston to the pumpdown connection; and a fin.

2. The apparatus of claim 1, wherein the fin is connected to the ring connection.

3. The apparatus of claim 1, wherein the fin is connected to the pumpdown connection.

4. The apparatus of claim 1, wherein the sleeve includes a first sleeve segment and a second sleeve segment connected to each other by the sleeve connection.

5. The apparatus of claim 1, wherein the first spring is longer than the second spring; and a first distance, between the first end and the flange, is greater than a second distance, between the flange and the second end.

6. The apparatus of claim 1, further comprising a handle releasably coupleable to the sleeve.

7. A method of placing a tool in a landing ring of a drilling tubular, comprising:

pumping the tool, connected to a shock absorber apparatus, into the drilling tubular toward the landing ring, absorbing a first shock, the first shock caused by a fin of the shock absorber apparatus being brought into contact with the landing ring, the first shock being at least partially absorbed by a first spring of the shock absorber apparatus being compressed;

absorbing a second shock, the second shock caused when the first spring resiliently expands following the first shock, the second shock being at least partially absorbed by a second spring of the shock absorber apparatus being axially compressed.

* * * * *